US011536493B2

(12) United States Patent
McCauley et al.

(10) Patent No.: US 11,536,493 B2
(45) Date of Patent: Dec. 27, 2022

(54) REFRIGERATION SYSTEM FOR CHILLED STORAGE CONTAINER

(71) Applicants: Peter McCauley, Orlando, FL (US); Michael Joseph Short, Spring Lake, NJ (US)

(72) Inventors: Peter McCauley, Orlando, FL (US); Michael Joseph Short, Spring Lake, NJ (US)

(73) Assignee: Better Boating Partners LLC, Winter Garden, FL (US)

( * ) Notice: Subject to any disclaimer, the term of this patent is extended or adjusted under 35 U.S.C. 154(b) by 345 days.

(21) Appl. No.: 16/717,238

(22) Filed: Dec. 17, 2019

(65) Prior Publication Data

US 2020/0248931 A1 Aug. 6, 2020

Related U.S. Application Data

(60) Provisional application No. 62/800,623, filed on Feb. 4, 2019.

(51) Int. Cl.

| | |
|---|---|
| ***F25B 9/00*** | (2006.01) |
| ***F25D 17/02*** | (2006.01) |
| ***F25D 3/04*** | (2006.01) |
| ***F25B 7/00*** | (2006.01) |

(52) U.S. Cl.

CPC ..... *F25B 9/002* (2013.01); *F25B 7/00* (2013.01); *F25D 3/045* (2013.01); *F25D 17/02* (2013.01); *F25D 2300/00* (2013.01)

(58) Field of Classification Search

CPC ..... F25D 3/045; F25D 2300/00; F25D 17/02; F25B 41/30; F25B 41/345; F25B 9/002; F25B 7/00

See application file for complete search history.

(56) References Cited

U.S. PATENT DOCUMENTS

| | | | |
|---|---|---|---|
| 2,746,272 | A | 5/1956 | Carpenter |
| 2,931,192 | A | 4/1960 | Weinberg |
| 2,982,109 | A | 5/1961 | Puretic |

(Continued)

OTHER PUBLICATIONS

EPA, Phasing Out HCFC Refrigerants To Protect The Ozone Layer, Jul. 31, 2015, EPA-430-F-09-080 (Year: 2015).*

*Primary Examiner* — Larry L Furdge
*Assistant Examiner* — Chang H Park
(74) *Attorney, Agent, or Firm* — Squire Patent Consulting & IP Law LLC; Brendan E. Squire

(57) ABSTRACT

A dual-phase refrigeration system for chilled storage containers (CSC) aboard boats maintains cold temperatures in the CSC by chilling the airspace in the upper portion of the CSC. A cooling liquid is circulated through coils installed on an interior sidewall about an upper margin of the CSC. The cooling liquid chills the air in the upper portion of the CSC which creates a thermodynamic airflow within the CSC which aids in cooling. The temperature of the cooling liquid is maintained by a heat exchange with a Non-Ozone Depleting Hydrofluorocarbon (NODHFC) refrigerant which, in turn, is cooled by a heat exchange with circulating water sourced from the body of water supporting the boat. If ice is added to the CSC, the cooling liquid in the coils reduces the air temperature differential across air/ice interface and maintains the quality of the ice.

11 Claims, 4 Drawing Sheets

(56) References Cited

U.S. PATENT DOCUMENTS

| | | | | | |
|---|---|---|---|---|---|
| 3,159,982 | A | * | 12/1964 | Schachner | B60H 1/32281 62/175 |
| 3,260,065 | A | | 7/1966 | Teixeira | |
| 3,696,631 | A | | 10/1972 | Valdes | |
| 3,729,948 | A | | 5/1973 | Schwartz | |
| 3,961,925 | A | | 6/1976 | Rhoad | |
| 4,276,752 | A | | 7/1981 | Moder et al. | |
| 5,953,934 | A | * | 9/1999 | Makino | F25B 43/02 62/470 |
| 6,237,361 | B1 | | 5/2001 | Broussard | |
| 6,272,879 | B1 | | 8/2001 | Lopez-Ordaz | |
| 6,658,889 | B2 | | 12/2003 | Krylov | |
| 7,024,814 | B1 | | 4/2006 | McDougle | |
| 8,485,132 | B2 | | 7/2013 | Kong | |
| 2005/0204610 | A1 | * | 9/2005 | Bogart | A01K 97/20 43/55 |
| 2016/0187013 | A1 | | 6/2016 | Becker | |

* cited by examiner

REFRIGERATION SYSTEM FOR CHILLED STORAGE CONTAINER

CROSS-REFERENCE TO RELATED APPLICATION

This application claims the benefit of priority of U.S. provisional application No. 62/800,623, filed on Feb. 4, 2019, the contents of which are herein incorporated by reference.

BACKGROUND OF THE INVENTION

The present invention relates to refrigeration systems for chilled storage containers (CSC), or more particularly, to a refrigeration system for CSC's aboard boats.

Currently, cold temperatures are difficult to maintain in CSC's or other storage containers aboard boats. The natural process of warming is often accelerated by inadequate insulation, frequent opening and closing of the unit, intrusion of saltwater into the box, and the radiant heating from the sun warming the top of CSC. If the CSC contains ice for enhanced cooling, these warming processes can result in the melting of the ice.

Current systems use a single-phase cooling system to chill freezer plates, which are inadequate for the task. A "single-phase system" means that the system operates with a single refrigerant as the cooling agent that is delivered directly to freezer plates in the CSC. The design of these systems usually requires the use of rigid, typically copper, tubing to carry high pressure refrigerant in a liquid form to expansion valves which must be located in close proximity to the freezer plates. This often requires the construction of a compartment within the CSC to contain the expansion valve and other components. This system is prone to failure because in an environment with significant vibration, impact, and other stresses, the rigid lines are susceptible to failure and may leak the coolant out of the system. Such leaks can lead to the venting of potentially ozone depleting gases like chlorofluorocarbons (CFC) used in some competitive systems. Additionally, "walling off" this space reduces the size of the chilled storage container available for use by boaters. The "walling off" process does not fully prevent, water, debris, fish blood, slime, and potentially fish meat and entrails from entering and potentially becoming trapped in the "walled-off" area, creating unsanitary conditions. The equipment in the space, including the expansion valve, is exposed to corrosive saltwater and powerful chemicals and cleaners used to try to prevent harmful bacteria growth.

"Single-phase" systems also lack cooling capacity, particularly during a "recovery phase" which occurs when heat is added to the CSC, which occurs during normal opening and closing, or the addition of a heat source like a fish or other warm product like beverages. The systems have a low mass of cooling inertia which is a function of the volume and temperature of coolant in the CSC. Since the plates are mounted lower in the box, they often "freeze up," meaning that ice accumulates rapidly on the plate, but the cooling effect is not evenly distributed across the box.

There exists a need for a cooling system that removes heat and maintains any ice in the box, is easy to clean, optimizes thermodynamic effectiveness, is eco-friendly, and improves the ability to achieve low temperatures in the CSC.

SUMMARY OF THE INVENTION

Figure 1:
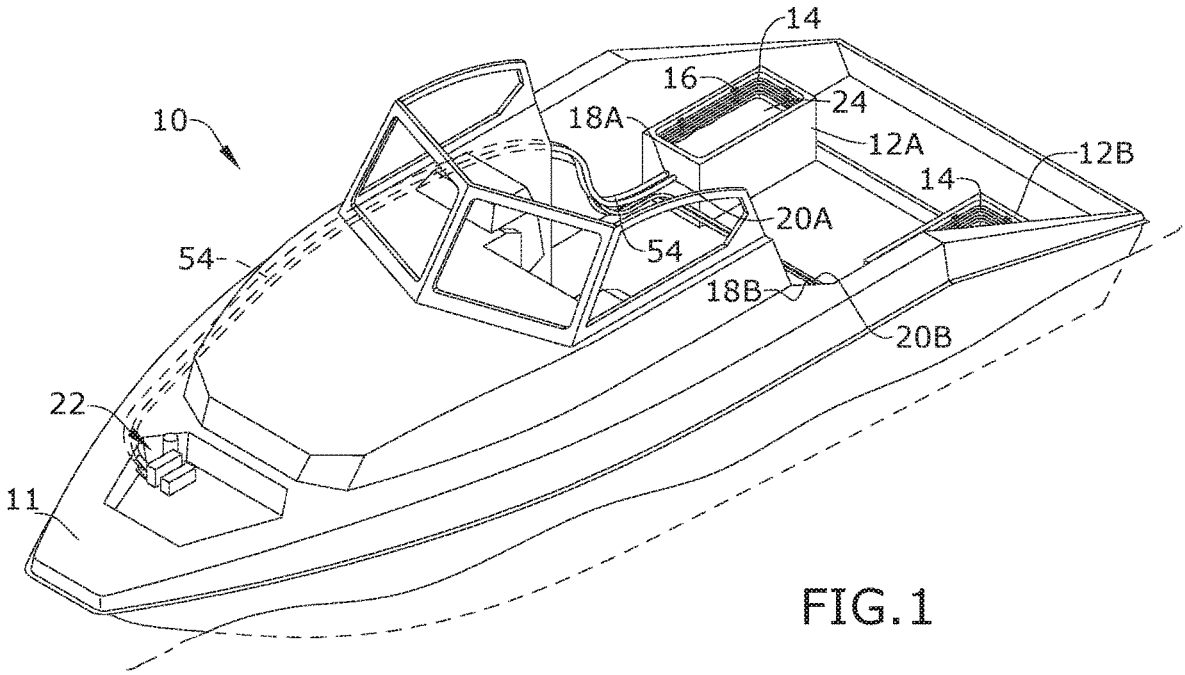
FIG. 1 shows a perspective view of one embodiment of a refrigeration system for chilled storage container (CSC)
Figure 2:
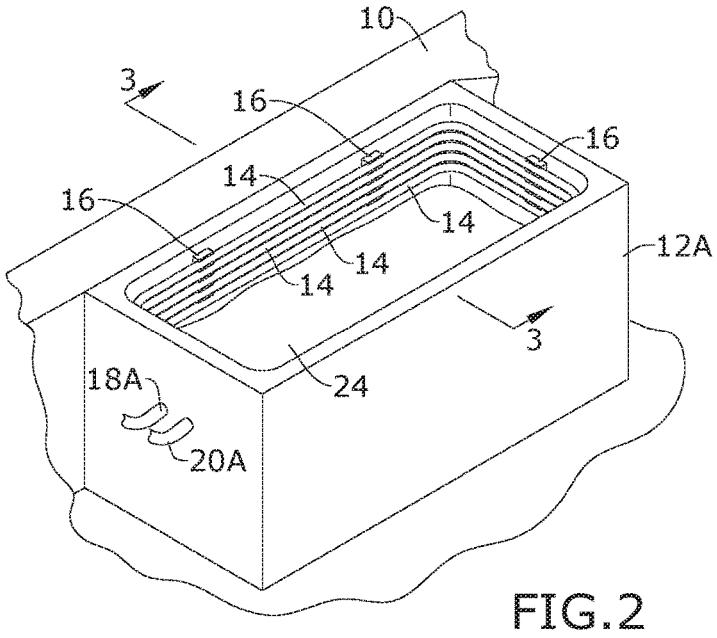
FIG. 2 shows a detailed perspective view of a CSC.
Figure 3:
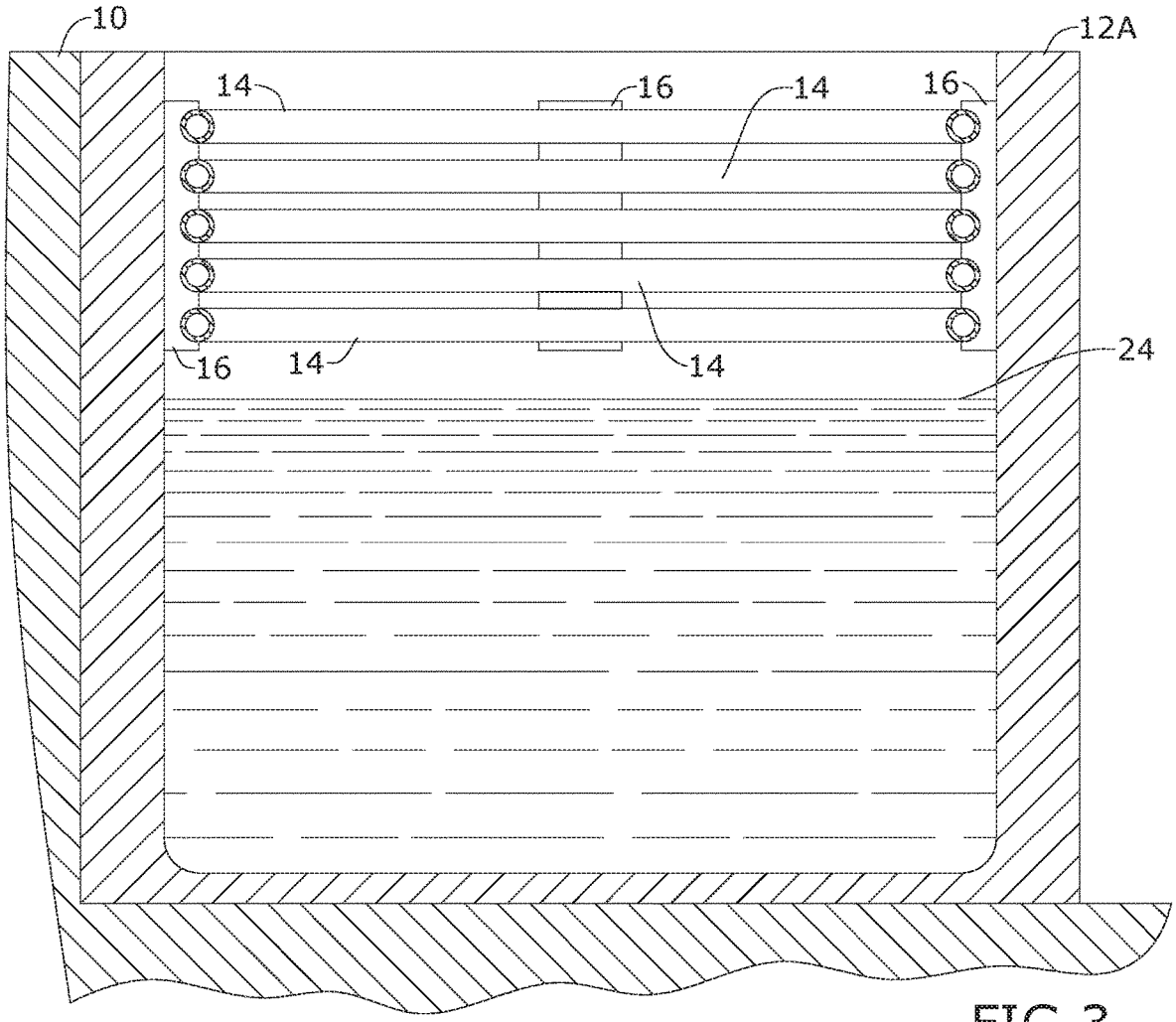
FIG. 3 shows a section view of the CSC invention, taken along line 3-3 of FIG. 2.

In one aspect of the invention, a refrigeration system for a chilled storage container (CSC) in a boat is disclosed. The refrigeration system includes an input coolant tube that is configured for communication of a cooling liquid to an interior cavity of the CSC. An output coolant tube is configured for communication of the cooling liquid from the interior cavity of the CSC. A conduit is disposed in a plurality of coils that are configured to be attached to an interior sidewall of the CSC. The plurality of coils are disposed about an upper margin of the interior sidewall. The conduit is in communication with the input coolant tube and the output coolant tube. A circulation pump is provided for circulating the cooling liquid through the input coolant tube, the plurality of coils, and the output coolant tube.

In some embodiments, a plate is configured for attachment to the interior sidewall of the CSC. The plate holds the plurality of coils in a vertically spaced configuration within the interior cavity.

In some embodiments, an evaporator has a first channel communicating the cooling fluid and is configured for thermal exchange with a Non-Ozone Depleting Hydrofluorocarbon (NODHFC) refrigerant carried in a second channel of the evaporator.

In some embodiments, a compressor or series of compressors is/are in communication with the second channel of the evaporator. The compressor is selectively operable to compress the low-pressure gaseous NODHFC refrigerant from the evaporator to a high-pressure gaseous state.

In some embodiments, a condenser has a first channel that is configured to receive the high-pressure gaseous NODHFC refrigerant from the compressor and deliver high-pressure liquid NODHFC refrigerant to the receiver. A second channel of the condenser is configured for thermal exchange with a circulating water source carried in a second channel of the condenser. The inlet of the second channel of the condenser is in communication with hoses delivering circulating water and the outlet of the condenser is in communication with hoses that expel the circulating water overboard.

In yet other embodiments, an outlet of the second channel of the condenser is in communication with the body of water.

In other aspects of the invention, a two-phase thermal exchange system for extracting thermal energy from a chilled storage container (CSC) in a boat is disclosed. The two-phase thermal exchange system includes a condenser configured for thermal exchange between a NODHFC refrigerant carried through a first channel of the condenser and a circulating water carried through a second channel of the condenser. Hoses aboard the boat deliver the circulating water from a body of water supporting the boat. An evaporator is configured for thermal exchange between a cooling fluid carried through a first channel of the evaporator and the NODHFC refrigerant that is carried through a second channel of the evaporator. A circulation pump or pumps are configured to circulate the cooling liquid between the evaporator and a plurality of coils installed to plates attached to the interior sidewall of the CSC.

In other embodiments of the system, a compressor or series of compressors is/are provided for selectively compressing the NODHFC refrigerant between a low-pressure gas upon exiting the evaporator and a high-pressure gaseous state for entering the condenser.

In yet other embodiments, an expansion valve is disposed proximal to an inlet to the evaporator. The expansion valve is in communication with the outlet of the receiver and receives high-pressure NODHFC refrigerant liquid from the receiver. It is selectively operable by the solenoid and converts high-pressure liquid NODHFC refrigerant to a low-pressure liquid for delivery to the evaporator.

In yet other aspects of the invention, a method of extracting thermal energy from a chilled storage container (CSC) in a boat is disclosed. The method includes circulating water from a body of water supporting the boat through a second channel of a condenser. The water absorbs heat from a NODHFC refrigerant circulating through a first channel of the condenser. A cooling liquid is also circulated through a first channel of an evaporator for thermal exchange to the NODHFC refrigerant circulating through a second channel of the evaporator. The cooling liquid is circulated through a conduit disposed as a plurality of coils within an interior cavity of the CSC for thermal exchange between the interior cavity of the CSC and the cooling liquid.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, embodiments of the current invention provide a two-phase refrigeration system 10 for a CSC 12 carried aboard a boat 11. The two-phase refrigeration system 10 extracts heat from the CSC 12 and chills the interior cavity and airspace in an upper portion of the CSC 12. A cooling liquid is circulated through a conduit disposed as a plurality of coils 14 within the CSC 12. By cooling the air at the top of the CSC, the invention takes advantage of thermodynamic properties of air, namely, cold air descends forcing warm air to rise and come in contact with the cooling coils. Preferably, the plurality of coils 14 are installed above an ice level 24 within the interior cavity of the CSC 12. The cooling liquid is circulated through an interior heat exchanger formed by the plurality of coils 14 that chills the air and slows or reduces melting of ice 24 carried within the CSC 12.

In another embodiment, additional coils are added to the exterior surface of the CSC to further enhance cooling.

Often boaters add ice 24 to CSC's to further enhance cooling. Typically, the greatest cause of ice 24 melting is the temperature differential between the ice 24 and that of the air above it. The cooling liquid circulates within the plurality of coils 14, advantageously reduces the air temperature, and eliminates the temperature differential across this large surface area. The present invention maintains ice 24 better, is easy to clean, and provides a greater mass of cooling energy within the CSC 12. The system 10 achieves lower temperatures in the CSC 12 because: the cooling liquid can circulate in the coils at much lower temperatures than the average temperature of Freon in a "single-phase" system, the surface area of cooling coils is much greater than the comparable surface area of the freezer plates, and the thermodynamically advantaged design of the coil location creates a natural air circulation within the CSC which aids cooling. Further, the claimed system is made of high-quality parts, which have demonstrated their ability to be durable at sea. The claimed system confines the use of environmentally friendly hydrofluorocarbons (HFC) to the NODHFC refrigerant in the refrigeration skid 22 which is located in a protected area aboard the boat. By comparison, the refrigeration gases used in competitive systems, that may contain ozone depleting chloroflourocarbons CFC's, are circulated through rigid lines in more vulnerable areas that are susceptible to leaks.

FIG. 1 shows a non-limiting embodiment of a two-phase cooling system 10 of the present invention installed on a boat 11. The system may include a starboard side CSC 12A having a conduit disposed in a plurality of cooling coils 14A about an upper margin of the CSC 12. Preferably, the conduit is made of a stainless steel tubing. The plurality of cooling coils 14A are attached to an interior sidewall of the CSC 12A and are maintained in a vertically spaced configuration by a plurality of coil support brackets 16.

The starboard CSC 12A includes an input coolant tube 20A, and an output coolant tube 18A extending through a sidewall of the starboard CSC 12A and connected to a first end and a second end of the conduit, respectively. The port CSC 12B includes an input coolant tube 20B, and an output coolant tube 18B extending through a sidewall of the port CSC 12B and connected to a first end and a second end of the conduit, respectively.

In some embodiments, the two phase cooling system 10 may also be configured with a port side CSC 12B with cooling coils 14B, a port cooling coil input 20B, and a port cooling coil output 18A. The starboard 12A and port 12B CSCs may be positioned where they may be conveniently opened to receive one or more fish, such as may be caught during a fishing expedition or charter. As will be appreciated, the CSCs 12A, 12B may also store other items in need of refrigeration.

A plurality of insulated flex tubes 54 connect the input of each CSC 12A and 12B with a corresponding port circulation pump 36 and a starboard circulation pump 38. Each of the starboard circulation pump 36 and the port circulation pump 38 may be independently controlled to circulate the cooling liquid through the coils 14A, 14B in the CSCs 12A, 12B. An Accumulator 40 may be provided proximal in communication with the flex tubes to accommodate the expansion and contraction of the cooling liquid.

In some embodiments, additional CSC's can be supported by the same refrigeration system using a additional set of insulated flex tubes.

The cooling liquid is circulated through a first circulation channel of an evaporator 26, where thermal energy in the cooling liquid is exchanged with a chilled NODHFC refrigerant carried in a second circulation channel of the evaporator 26.

Thermodynamic air flow in the CSC is the result of cold air, that is denser than warm air, tends to fall and force the warmer air up within the CSC 12. This brings the warm air toward the plurality of coils 14A, 14B where it is cooled by heat exchange with coils containing a circulating cooling liquid. This creates a thermodynamic circulation of air within the chilled storage containers 12A and 12B. This effect is enhanced by the large cooling surface area of the coils and the spacing between the coils which optimizes air flow.

The claimed system exploits these thermal properties of air to extract heat from the chilled storage containers 12A and 12B. If the contents are ice 24, this cooled air reduces or eliminates the temperature differential across the air/ice interface and slows or eliminates ice 24 melting.

Figure 4:
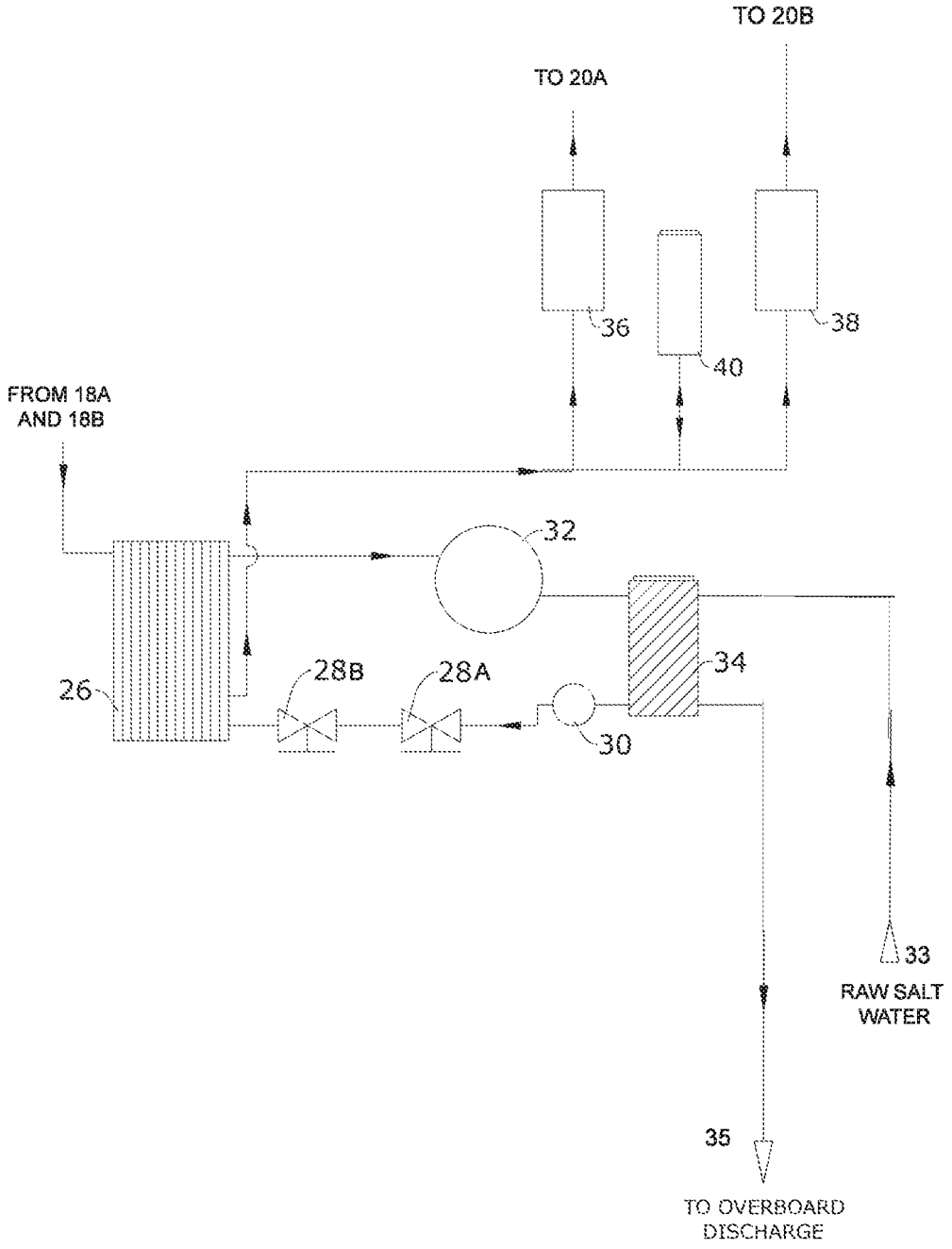
FIG. 4 shows a schematic view of the a refrigeration system for chilled storage container (CSC)

Having previously described the second phase of the system 10, the two-phase heat exchange system 10 is illustrated in the schematic view of the refrigeration skid 22, shown in FIG. 4. In the first phase, circulating water enters a condenser 34 through flexible hoses from a source of circulating water, typically through an inlet 33 from a body of water supporting the boat 11. This circulating water flows through the second channel of the condenser 34 and absorbs heat from the warm NODHFC refrigerant which is circulating in a first channel of the condenser 34. After the circulating water extracts heat from the NODHFC refrigerant in the condenser 34 it is routed overboard for discharge from the boat 11 via a discharge port 35.

The NODHFC refrigerant changes state in the condenser 34 as it is cooled by the circulating water and exits the condenser 34 as a high-pressure liquid. The liquid NODHFC refrigerant may be stored in a receiver 30 until it is required for cooling the liquid coolant in the evaporator 26.

Figure 5:
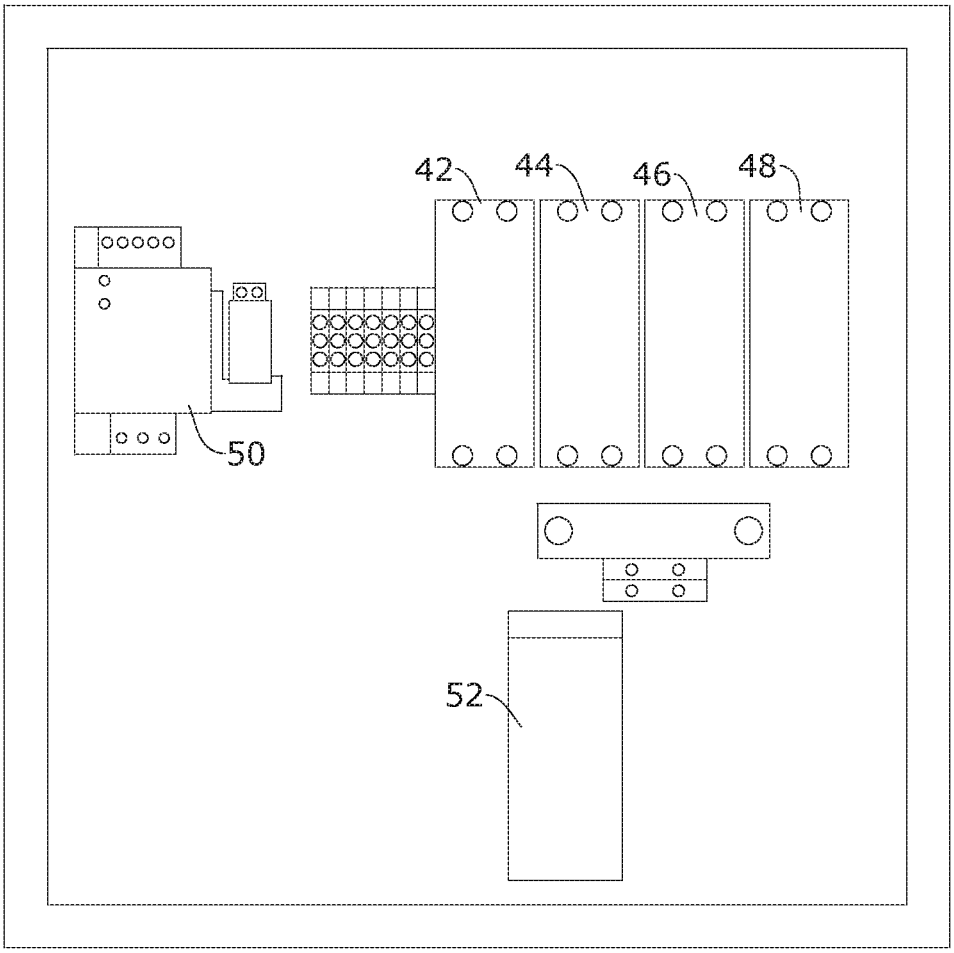
FIG. 5 shows a schematic view of an embodiment of a Control Module (CM).

When energized by a signal from a CM, shown in FIG. 5, the solenoid valve 28A opens and the NODHFC refrigerant passes through an expansion valve 28B, where it is converted into a low-pressure liquid NODHFC refrigerant. In phase 2, low-pressure liquid NODHFC refrigerant from the expansion valve 28B enters the evaporator 26 where it absorbs heat from the cooling liquid. The NODHFC refrigerant changes state again in the evaporator 26 and exits as a low-pressure gas. The low-pressure NODHFC refrigerant gas moves to the compressor or series of compressors 32 where it increases in temperature and pressure. Then it flows back to the condenser 34 where it is cooled back into a high-pressure liquid as described in Phase 1.

In a preferred embodiment, the cooling liquid is a food grade liquid to enhance boater and food safety. The chilled cooling liquid is circulated by the circulation pumps 36, 38 to be carried from the evaporator 26 and through the plurality of coils 14A, 14B in the CSC 12A, 12B. The plurality of coils 14A, 14B are chilled by the circulating cooling liquid and reduce the air temperature in the CSC 12A, 12B so that the temperature across the ice/air interface is optimized.

A control module (CM) is shown in reference to FIG. 5. The CM allows the operator to set a desired temperature for the air within the CSC 12A, 12B, and operates as a thermostat, which turns the refrigeration skid on and off as needed to maintain the air temperature. The CM may include a starboard pump switch 42, a port pump switch 44, a Liquid Line Solenoid (LLS) switch 46, a compressor switch 48, a power supply controller 50, and control module 52. In one embodiment, data from a thermostat, contained within the CSC 12A, 12B is processed by the CM it and controls the operation of the system.

In additional embodiments, the claimed system can be used to cool any container, which has access to electrical power. These embodiments can also include flexible radius tubes in lieu of or in combination with coils 14 to conform to irregular spaces and enable after-market installations.

Advantageously, the claimed invention better maintains low temperatures, better preserves the ice 24, is easy to clean, and provides a greater degree of temperature control within the CSC as compared to existing systems. The claimed system can achieve lower temperatures in the CSC because; the cooling liquid circulates at a much lower temperature than existing freezer plates can maintain, the cold surface area of the coils far exceeds that of the freezer plates, and the location of the coils in the upper portion of the CSC exploits the thermodynamic properties of air to create a natural air circulation which aids in the cooling process. The claimed invention contains a greater mass of cooling media, uses cooling media with a higher capacity to absorb heat, and more uniformly distributes cooling energy throughout the storage container. The mass of cooling liquid combined with the significant mass of cooling coils creates a thermal bank of cooling inertia, capable of quickly responding to warm air intrusions from the opening of the container or from adding a heat source like a recently caught fish.

In preferred embodiments, the claimed system is made of high-quality parts, which have demonstrated their ability to be durable at sea. As a result, the system has greater reliability and the boater does not have to sacrifice cool space to create a "walled off" area to protect components of this invention.

It should be understood, of course, that the foregoing relates to exemplary embodiments of the invention and that modifications may be made without departing from the spirit and scope of the invention as set forth in the following claims.

What is claimed is:

1. A dual-phase refrigeration system for a chilled storage container (CSC) in a boat comprising:

an input coolant tube configured for communication of a cooling liquid to an interior cavity of the CSC;

an output coolant tube configured for communication of the cooling liquid from the interior cavity of the CSC;

a conduit disposed in a plurality of coils configured to be attached to an interior sidewall of the CSC about an upper margin of the interior sidewall, the conduit in communication with the input coolant tube and the output coolant tube; and a circulation pump for circulating the cooling liquid through the input coolant tube, the plurality of coils, and the output coolant tube.

2. The refrigeration system of claim 1, further comprising:

a plate designed for attachment to the interior sidewall of the CSC, the plate holding the plurality of coils in a vertically spaced configuration about the upper margin of the interior sidewall of the CSC.

3. The refrigeration system of claim 1, further comprising:

an evaporator having a first channel communicating the cooling liquid and configured for thermal exchange with a non-ozone depleting hydrofluorocarbon (NODHFC) refrigerant carried in a second channel of the evaporator.

4. The refrigeration system of claim 3, further comprising:

a compressor or series of compressors in communication with the second channel of the evaporator, the compressor selectively operable to compress the NODHFC refrigerant to a high-pressure gaseous state.

5. The refrigeration system of claim 4, further comprising:

a condenser having a first channel of the condenser configured to receive the NODHFC refrigerant from the compressor; and a second channel of the condenser circulating a circulating water, the condenser configured for a thermal exchange between the NODHFC refrigerant and the circulating water.

6. The refrigeration system of claim 5, further comprising:

the condenser having the second channel of the condenser configured to receive circulating water from hoses in connection with a source of circulating water.

7. The refrigeration system of claim 6, further comprising:

an outlet of the second channel of the condenser in communication with a body of water.

8. A two phase thermal exchange system for extracting thermal energy from a chilled storage container (CSC) in a boat, comprising:

a condenser configured for thermal exchange between a non-ozone depleting hydrofluorocarbon (NODHFC) refrigerant carried through a first channel of the condenser and circulating water carried through a second channel of the condenser, an evaporator configured for thermal exchange between a cooling liquid carried through a first channel of the evaporator and the NODHFC refrigerant carried through a second channel of the evaporator; and a circulation pump or pumps configured to circulate the cooling liquid between the evaporator and a plurality of coils adapted to be installed to an upper margin of an interior sidewall of the CSC, above an ice containment level in a lower portion of an interior cavity of the CSC, wherein a thermodynamic airflow of cold air above the ice fill level is induced by the plurality of coils to reduce a temperature differential at an air/ice interface within the CSC.

9. The two-phase thermal exchange system of claim 8, further comprising:

a compressor for selectively compressing the NODHFC refrigerant between a low-pressure gaseous state upon exiting the evaporator and a high-pressure gaseous state upon entering the condenser.

10. The two-phase thermal exchange system of claim 9, further comprising:

an expansion valve is disposed proximal to an inlet to the evaporator, the expansion valve in communication with an outlet of the receiver and receives high-pressure NODHFC refrigerant liquid from the receiver, the expansion valve is selectively operable by a solenoid and converts high-pressure liquid NODHFC refrigerant to a low-pressure liquid for delivery to the evaporator.

11. A method of extracting thermal energy from a chilled storage container (CSC) in a boat, comprising:

circulating water from a body of water supporting the boat through a second channel of a condenser, the water absorbing heat from a non-ozone depleting hydrofluorocarbon (NODHFC) refrigerant circulating through a first channel of the condenser, circulating a cooling liquid through a first channel of an evaporator for thermal exchange to the NODHFC refrigerant circulating through a second channel of the evaporator; and circulating the cooling liquid through a conduit disposed as a plurality of coils within an upper margin of an interior cavity of the CSC above an ice fill level of the CSC, wherein a thermodynamic airflow of cold air above the ice fill level is induced by the plurality of coils to reduce a temperature differential at an air/ice interface within the CSC.

* * * * *